US005678268A

United States Patent [19]

Lee

[11] Patent Number: 5,678,268

[45] Date of Patent: Oct. 21, 1997

[54] METHOD FOR CONTROLLING LAUNDERING OF LOW FREQUENCY OSCILLATION WASHING SYSTEM

[75] Inventor: Joo Hwan Lee, Kwacheon, Rep. of Korea

[73] Assignee: LG Electronics Inc., Seoul, Rep. of Korea

[21] Appl. No.: 580,758

[22] Filed: Dec. 29, 1995

[30] Foreign Application Priority Data

Jul. 11, 1995 [KR] Rep. of Korea ..... 20372/1995

[51] Int. Cl.[6] ..... D06F 33/02

[52] U.S. Cl. ..... 8/159

[58] Field of Search ..... 8/159; 68/12.01, 68/12.02, 12.12

[56] References Cited

U.S. PATENT DOCUMENTS 5,432,969 7/1995 Oh ..... 8/159

*Primary Examiner*—Philip R. Coe

*Attorney, Agent, or Firm*—John P. White

[57] ABSTRACT

The present invention discloses a method for controlling laundering of a low frequency oscillation washing system to enhance the laundering effect by maintaining resonance phenomena inside of a wash tub in a resonant laundering by oscillation. The inventive method therefor includes the steps of keeping up the resonant condition by a pulsator to a first wash time at a speed of a first oscillating frequency by selecting a washing or rinsing procedure; continuously keeping up the resonant condition of the above first step to a second wash time at a speed of a second oscillating frequency; producing a speed of a third oscillating frequency to prevent the extinction of the resonant condition maintained at the second step and retain the continuous resonance; and repeatedly performing the operation through which each speed of the first, second and third oscillating frequencies is intermittently increased or decreased up to a predetermined wash time by generating an interrupt.

3 Claims, 2 Drawing Sheets

F. I G.1
prior art
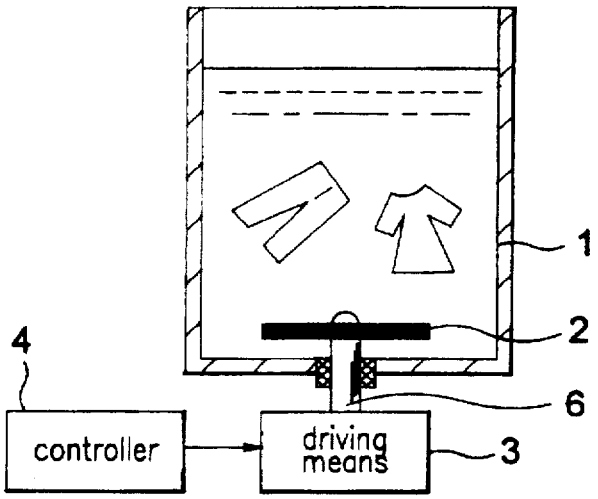
F. I G.2
prior art
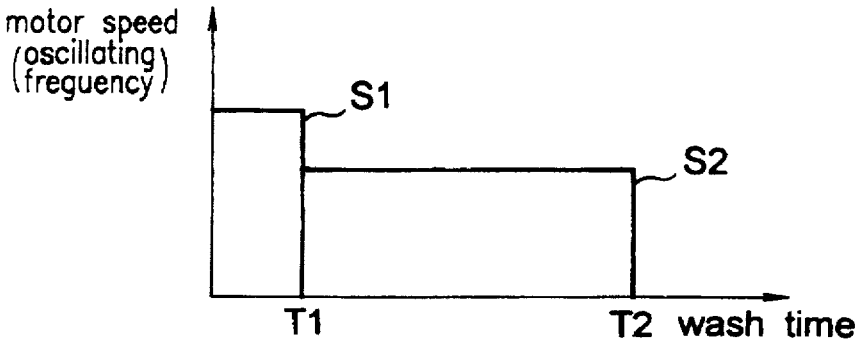
F I G.3
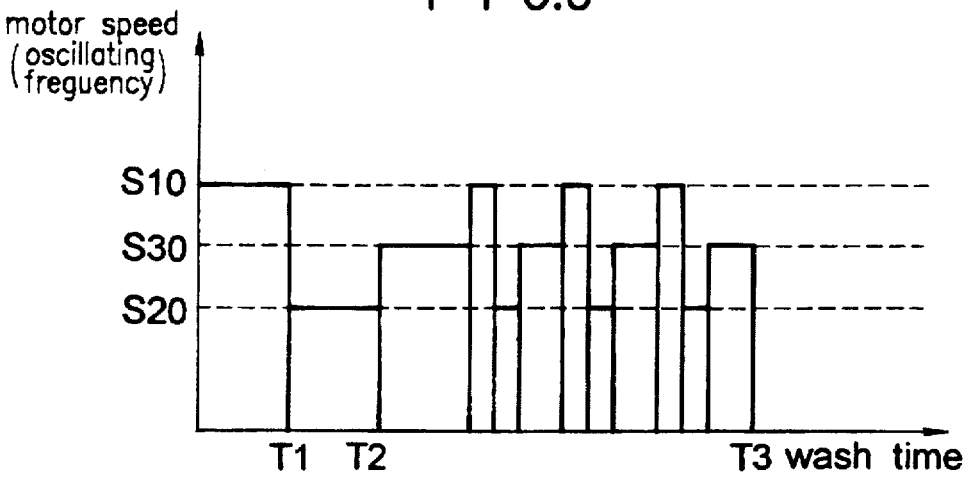

METHOD FOR CONTROLLING LAUNDERING OF LOW FREQUENCY OSCILLATION WASHING SYSTEM

BACKGROUND OF THE INVENTION (1) Field of the Invention

The present invention relates to a method for controlling laundering of a low frequency oscillation washing system. More particularly, it relates to a method for controlling laundering of a low frequency oscillation washing system that can keep resonance phenomena inside of a wash tub in resonant laundering by oscillation to produce a cleaner wash.

(2) Description of Prior Art

A general washing system includes a pulsator in a wash tub to which positive ore reverse turning force that is produced from a linear motor of the washing machine is transferred through a speed reducer such as a clutch. As the pulsator rotates, a heart water current or rotary water current is created in a washing liquid inside of the wash tub to carry out laundering.

In the laundering system by the power or continuous movement of the water current, the mechanical energy produced by the shearing stress of fluid, bending and stretching of laundry and the effect of friction, and the chemical action of a detergent interact to remove soil from clothing and fabrics.

In the washing system, however, twist and tangle of laundry in the wash tub by positive and reverse turning force of the pulsator, are produced to cause damage to the laundry, and the solubility of the detergent is lowered by the water current to result in excessive consumption of detergent.

In addition, even after the laundering, the residual detergent is being left to the laundry, which is deleterious to the human skin, and makes the wash time longer together with consuming a great amount of water for laundering.

As shown in FIG. 1, there was recently disclosed a low frequency oscillating washing machine that can perform laundering, using the mechanical energy by cavitation phenomena or nonlinear oscillation of minute bubbles in a multiphase medium resulting from the resonance phenomena in the multiphase medium consisting of water, detergent and a pneumatic layer within the wash tub, and the chemical action by the detergent. The following description relates to each part of this washing system.

FIG. 1 is a schematic view of a conventional low frequency oscillation washing machine, and FIG. 2 is a graph showing oscillating frequency and wash time by the method for controlling laundering of the low frequency oscillation washing system of FIG. 1.

The conventional low frequency oscillation washing system includes a wash tub 1 taking therein a multiphase medium consisting of water, detergent and a pneumatic layer, a pulsator for low frequency oscillation mounted on the upper portion of rotary pivot 6 creating resonance phenomena in the multiphase medium inside of the wash tub 1, and a driving means 3 that is formed underneath the rotary pivot 6 on which the pulsator is mounted and drives the pulsator 2 in a horizontal direction. The above washing system further includes a controller 4 connected to the driving means 3 to provide a displacement amplitude signal and a frequency signal.

The driving means 3 has a linear motor (not illustrated) to drive the pulsator 2, and a wash cover 5 is disposed on the inlet of the wash tub 1.

In the conventional oscillation washing machine, when the controller 4 generates a control signal to drive the linear motor inside of the driving means 3, the pulsator 2 connected to the linear motor pulsates in a vertical direction. Laundering force is generated in the wash tub 1 by oscillation of the pulsator 2 to launder clothing and fabrics. The pulsator 2 has an amplitude ranging from 2 to 25 mm at an oscillating frequency of 20 Hz to 250 Hz, and rotates with a rotary angle of 2°to 10°.

As shown in FIG. 2, the driving means 3 is controlled to have a first oscillating frequency S1 for a wash time of T1 from the start of the wash procedure. As the wash time T1 passes, the oscillating frequency of the pulsator 2 is lowered to be driven, keeping a resonance speed at a second oscillating frequency S2 lower than the first oscillating frequency until the next wash time T2 comes.

At this point, picking up speed to the first oscillating frequency S1 during the initial wash time T1, makes resonant the oscillation inside of the wash tub 1, and increasing speed to the second oscillating frequency S2 during the next wash time T2 keeps the resonance inside of the wash tub 1.

According to such a method for controlling laundering of a low frequency oscillation washing system, the motor is driven for the period of time T1 at a speed of the first oscillating frequency S1 to invite resonance, and when the laundering is carried out by the wash time T2 at a speed of the second oscillating frequency S2, the medium of the water for laundering is changed as the detergent put into the wash tub along with the water during the wash procedure from the initial wash time T1 to the next wash time T2. Thus, even if the oscillating frequency S2 tries to be kept as an oscillating frequency S2 during the wash time from T1 to T2, the resonance frequency generated during the period of time T1 cannot be maintained, which deteriorates the performance of the oscillation washing system, and produces no effect on washing clothing and fabrics.

SUMMARY OF THE INVENTION

It is an object of the present invention to provide a method for controlling laundering of a low frequency oscillation washing system which can produce a cleaner wash by continuously producing speed of oscillating frequency that keeps resonance phenomena inside of a wash tub during the resonant laundering by oscillation.

In order to achieve the above object, the inventive method for controlling laundering of a low frequency oscillation washing system, comprises the steps of:

keeping up the resonant condition by a pulsator to a first wash time at a speed of a first oscillating frequency by selecting a washing or rinsing procedure;

continuously keeping up the resonant condition of the above first step to a second wash time at a speed of a second oscillating frequency;

producing a speed of a third oscillating frequency to prevent the extinction of the resonant condition maintained at the second step and retain the continuous resonance; and repeatedly performing the operation through which each speed of the first, second and third oscillating frequencies is intermittently increased or decreased up to a predetermined wash time by generating an interrupt.

BRIEF DESCRIPTION OF THE DRAWINGS

The above objects and other advantages of the present invention will become more apparent upon consideration of presently preferred embodiments of the present invention with reference to the attached drawings in which:

FIG. 1 is a schematic view of a low frequency oscillation washing system in accordance with an embodiment of a conventional technique;

FIG. 2 is a graph showing oscillating frequency and wash time by the laundering controlling method of the low frequency oscillation washing system of FIG. 1;

FIG. 3 is a graph showing oscillating frequency and wash time by a method for controlling laundering of a low frequency oscillation washing system in accordance with the present invention.

DETAILED DESCRIPTION OF THE PREFERRED EMBODIMENTS

Figure 4:
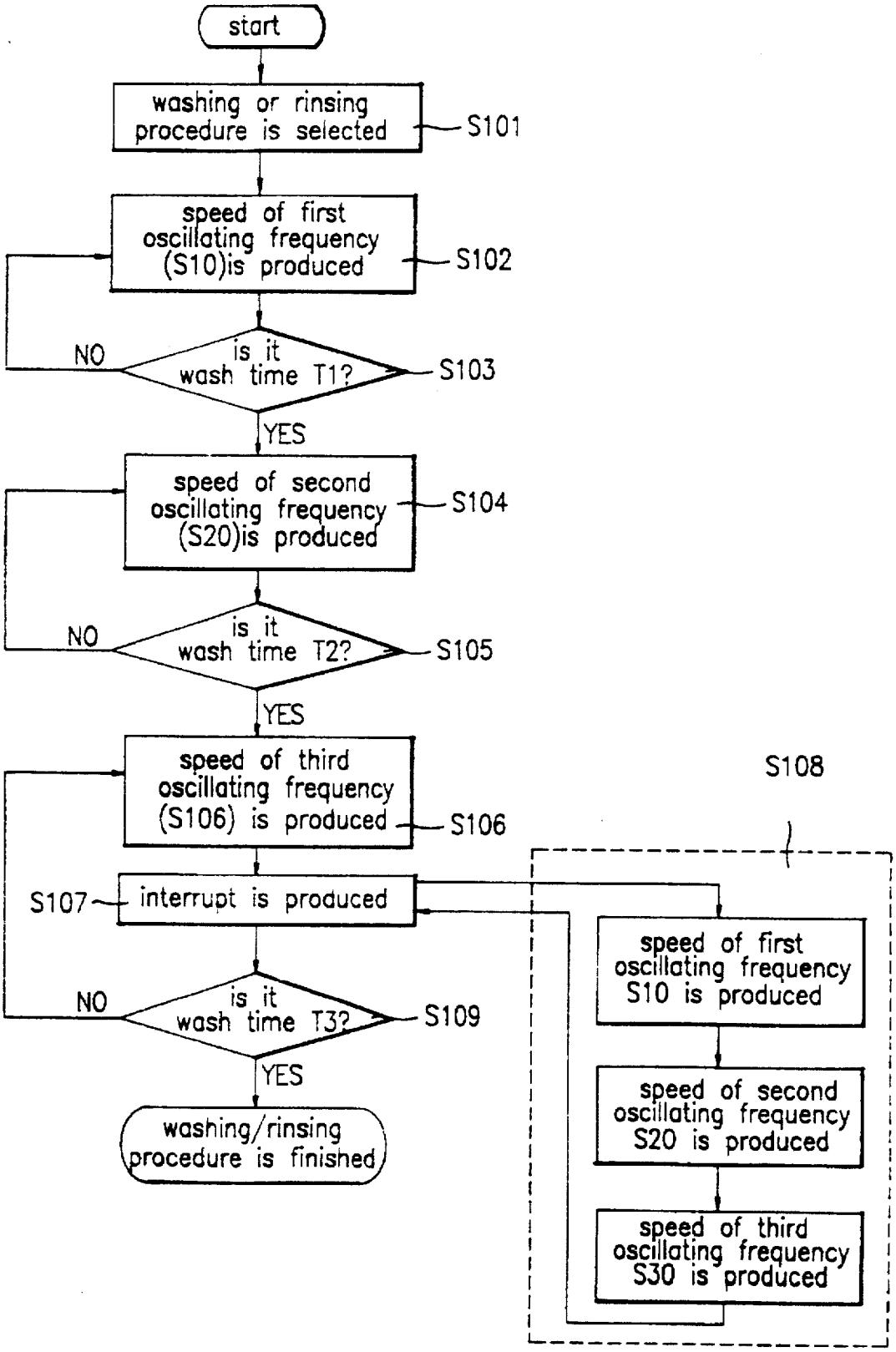
FIG. 4 is a Flow Chart of a method for controlling laundering of a low frequency oscillation washing system in accordance with a first preferred embodiment of the present invention.

Preferred embodiments of the present invention will now be discussed in detail with reference to the accompanying drawings.

FIG. 3 is a graph showing oscillating frequency and wash time by a method for controlling laundering of a low frequency oscillation washing system in accordance with the present invention, and FIG. 4 is a Flow Chart of a method for controlling laundering of a low frequency oscillation washing system in accordance with a first preferred embodiment of the present invention.

Referring to FIG. 3, a linear motor inside of a driving means 3 is accelerated at a speed of first oscillating frequency S10 by a controller 4 so that a pulsator 2 rotates in a vertical direction, keeping up the speed of the same oscillating frequency S10 by a wash time period of T1.

When the wash time T1 comes, the oscillating frequency of the pulsator 2 is lowered to decrease the oscillating speed, and the pulsator 2 is driven to keep up the resonance phenomena at a second oscillating frequency S20 by a wash time T2.

Since the resonance phenomena does not occur continuously, when the wash time T2 comes, the resonance phenomena is kept up by increasing speed to a third oscillating frequency S30 formed between the first oscillating frequency S10 and second oscillating frequency S20.

For continuous occurrence of the resonance, by reducing the speed of the first, second and third oscillating frequencies, the above procedure is repeated in sequence until the washing or rinsing procedure is finished.

The following description is about the method for controlling laundering of a low frequency oscillation washing system.

For starters, when power is applied to the washing system, a washing procedure or a rising procedure is selected by a user, as indicated at S101 in Flow Chart depicted in FIG. 4.

When the linear motor inside of the driving means 3 rotates in response to the controller 4 after the selection of the desired procedure, turning force by vertical movement is provided to the pulsator 2, and after the linear motor is accelerated at S102 to speed with the first oscillating frequency S10, the speed of the first oscillating frequency S10 is kept up at S103 until the wash time T1 where sufficient resonance is generated, comes.

When the wash time T1 comes, since the oscillating frequency of the pulsator 2 is lowered to a second oscillating frequency S20 to keep up the resonant condition created by the wash time T1, the speed of the linear motor is then reduced (S104) and the speed of the linear motor is constantly maintained to the second oscillating frequency S20.

Since the continuous resonance phenomena is not maintained by the second oscillating frequency S20, when the wash time T2 comes, the speed of the linear motor is accelerated (S106) to the third oscillating frequency S30 created between the first oscillating frequency S10 and second oscillating frequency S20. By carrying out an interrupt (S107) in the middle of accelerating to the third oscillating frequency (S30), the speed of the linear motor is repeatedly accelerated (S108) to the first, second and third oscillating frequencies (S10, S20 and S30) shorter than the wash time T1, T2 and T3 that is set as intermittent wash time, and the above steps are repeatedly carried out to the next wash time T3 so that the resonant condition by the pulsator 2 will be kept up (S109).

As mentioned above, the method for controlling laundering of the low frequency oscillation washing system, includes the steps of keeping up the resonant condition by the pulsator 2 to the first wash time T1 at a speed of the first oscillating frequency by selecting a washing or rinsing procedure, and continuously keeping up the resonant condition of the above first step to the second wash time T2 at a speed of the second oscillating frequency. The inventive method further includes the steps of producing speed of the third oscillating frequency to prevent the extinction of the resonant condition maintained at the second step and retain the continuous resonance; repeatedly performing the operation through which each speed of the first, second and third oscillating frequencies is intermittently increased or decreased up to a predetermined wash time by generating an interrupt, thereby enhancing the oscillation laundering performance.

When a washing or rinsing procedure is selected, by controlling the speed of the linear motor according to the oscillating frequency intermittently created by step, the resonant condition by the pulsator may be kept up to prevent the oscillation washing effect not to mention producing a cleaner wash in the oscillation washing system.

The preferred embodiment of the present invention is given by way of example, and the invention recited in the attached claims is not limited to the illustrative embodiment. Those of ordinary skill in the art will recognize that routine design changes may be made to the exemplary embodiments without departing from the scope of the claims.

What is claimed is:

1. A method for controlling laundering in a low frequency oscillation washing system, comprising the steps of:

(a) maintaining a resonant condition by using a pulsator for a first wash time at a speed of a first oscillating frequency;

(b) continuously maintaining the resonant condition of step (a) for a second wash time at a speed of a second oscillating frequency;

(c) producing a speed of a third oscillating frequency to continuously maintain the resonant condition of step (b); and (d) repeatedly performing steps (a), (b) and (c) wherein each speed of the first, second and third oscillating frequencies is intermittently increased or decreased by generating an interrupt up to a predetermined wash time.

2. The method of claim 1 further comprising repeating step (d) until a third wash time is reached, and the laundering is finished.

3. The method of claim 1, wherein said first, second and third oscillating frequencies are in the mutual relationship whereby the first oscillating frequency is greater than the third oscillating frequency which is greater than the second oscillating frequency.

* * * * *